US006503675B1

(12) United States Patent
Kabai

(10) Patent No.: US 6,503,675 B1
(45) Date of Patent: Jan. 7, 2003

(54) TONER AND TONER MANUFACTURING METHOD

(75) Inventor: Takahito Kabai, Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 7 days.

(21) Appl. No.: 09/661,796

(22) Filed: Sep. 14, 2000

(30) Foreign Application Priority Data

Sep. 20, 1999 (JP) ..... 11-265489

(51) Int. Cl.[7] ..... G03G 9/00

(52) U.S. Cl. ..... 430/108.3; 430/108.4; 430/108.6

(58) Field of Search ..... 430/108.3, 108.4, 430/108.6

(56) References Cited

U.S. PATENT DOCUMENTS

| | | | | |
|---|---|---|---|---|
| 5,053,305 A | * | 10/1991 | Aoki et al. | 430/110.4 |
| 5,543,259 A | * | 8/1996 | Schwarz et al. | 430/108.23 |
| 5,604,066 A | * | 2/1997 | Foucher et al. | 430/108.9 |
| 6,130,020 A | * | 10/2000 | Wada et al. | 430/108.6 |
| 6,376,146 B1 | * | 4/2002 | Ieda | 430/106.3 |

FOREIGN PATENT DOCUMENTS

JP 6-100849 12/1994

* cited by examiner

*Primary Examiner*—Mark A. Chapman
(74) *Attorney, Agent, or Firm*—Foley & Lardner

(57) ABSTRACT

Toners comprise toner mother particles in a mean particle size A [$\mu$m] containing a metallic complex and zinc stearate in a mean particle size 2-A [$\mu$m] externally added to the toner mother particles by 0.05–5.0%.

5 Claims, 2 Drawing Sheets

TONER AND TONER MANUFACTURING METHOD

BACKGROUND OF THE INVENTION

1. Field of the Invention

The present invention relates to toner that is used in development by printers, electronic-photographic apparatus and a toner manufacturing method.

2. Description of the Related Art

In electro-photographic apparatus or electrostatic recording apparatus, for making an electrostatic latent image formed on a photo-conductive drum or an electrostatic image holder that is made of dielectric into a visible image, a developing device is used. In this developing device, it is generally known that the fog of images is prevented and scattering of toner can be improved by sufficiently holding an amount of electric charge of toner contained in developer that is used for the development of an electrostatic latent image. As a definite method for retaining a sufficient amount of electric charge in toners, a Charge Control Agent (hereinafter, abbreviated to CCA) comprising such metallic complexes as zirconium complex, chromium complex, zinc complex, boron complex, iron complex, etc. is so far contained in toner mother particles.

However, conventional toner mother particles containing the CCA comprising the above-mentioned metallic complexes is able to secure a sufficient amount of electric charge by the CCA but the startup of charge is worse depending on using conditions; that is, a time is required to fully charge toner. Therefore, the quality of images may drop for the image fog when toner is initially used. Further, the device may be contaminated by scattering toner.

On the other hand, with the downsizing of apparatus and the full color development of images, the downsizing of a developing device is also demanded in recent years and the necessity for a developing device with the reduced capacity for containing developer increases as an inevitable consequence. Further, in a full color electronic-photographing apparatus, as the printing rate becomes higher than monochrome electronic-photographing apparatus, a probability for using toner immediately after supplied for the development in a developing device is increasing. As a result of reduced capacity of a developing device for storing developer and increase in the printing rate, it becomes necessary to accelerating the startup of the charging of toner mother particles more than before.

SUMMARY OF THE INVENTION

An object of the present invention is to provide toner that has a quick charging startup and is able to obtain a satisfactory amount of electric charge even at the initial stage of toner irrespective of a developer storage capacity of a developing device or increase in a printing rate and a clear and good image even in a full colored image without causing the image fog and the toner scattering to surroundings.

According to the present invention, toner comprising toner mother particles in a mean particle size A [$\mu$m] containing a metallic complex; and zinc stearate in a mean particle size 2-A [$\mu$m], externally added to the toner mother particles by 0.05–5.0% is provided.

Further, according to the present invention, a method for manufacturing toner is provided. The method comprises the steps of preparing toner mother particles containing a metallic complex; and externally adding zinc stearate to the toner mother particles by 0.05–5.0%.

DETAILED DESCRIPTION OF THE PREFERRED EMBODIMENTS

Figure 1:
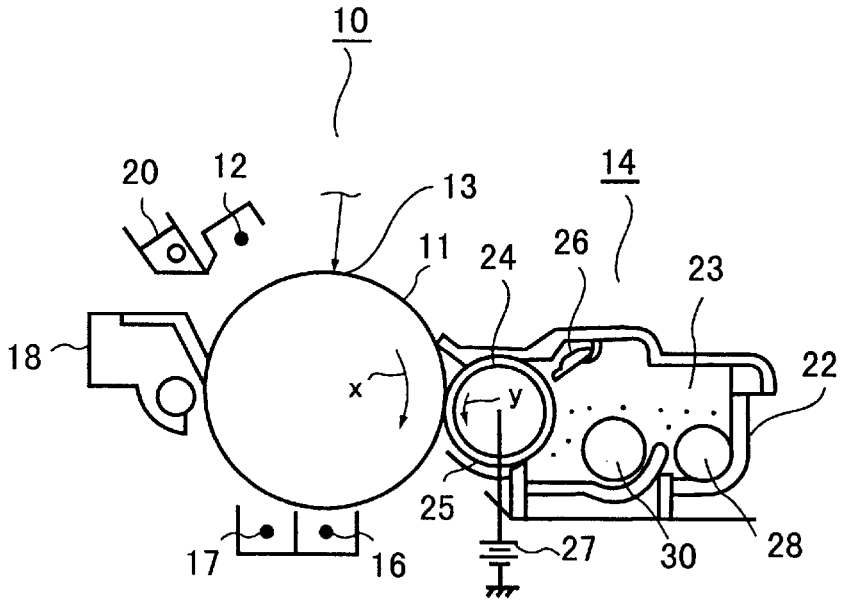
FIG. 1 is a schematic diagram showing an image forming unit of a digital copying machine that is used for a copy test of a toner of the present invention.
Figure 3:
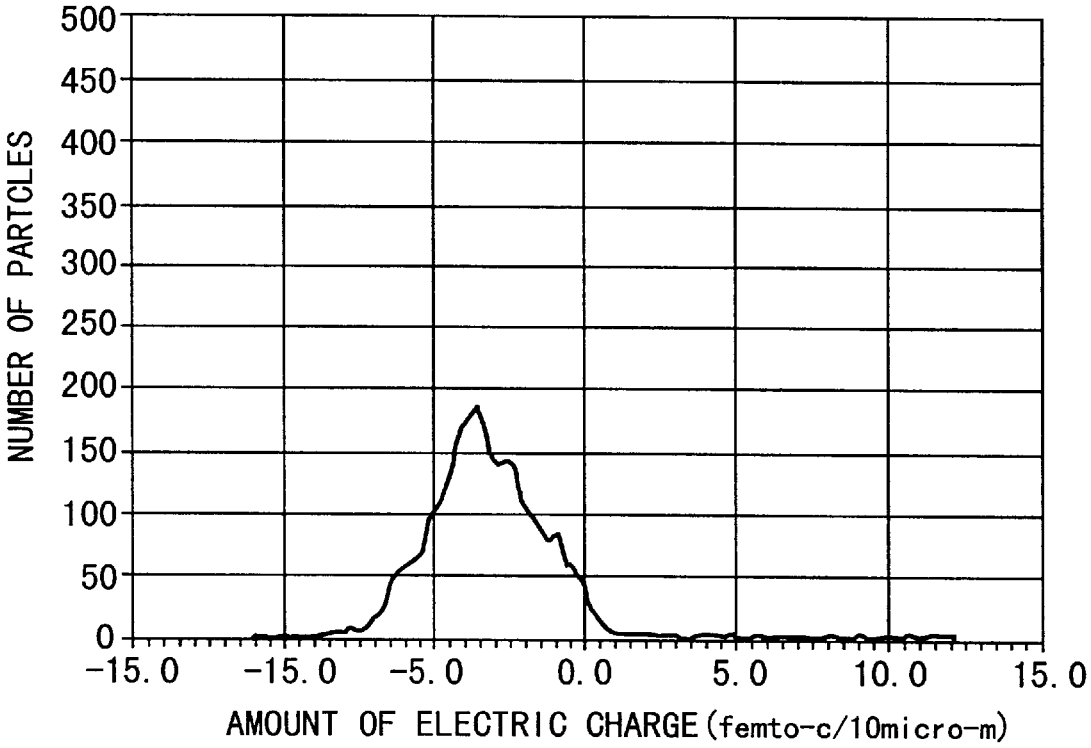
FIG. 3 is a graph showing the distribution of amount of electric charge to the number of particles of toner at the time of saturated charge causing image fog and toner scattering.

Preferred embodiments of the present invention will be described referring to FIG. 1 trough FIG. 3. The toner mother particles in the embodiments are manufactured as shown below. First, linear polyester resin having a softening point 100° C., that is a binder resin, is added with 4% of azo pigment as a coloring agent and a metallic complex as a CCA and they are mixed and dispersed using a high-speed fluid type mixer such as Henshel mixer. Then, they are heated, fused and kneaded using a pressure kneader and a roll. The obtained mixture is coarsely pulverized using a hammer mill, a jet mill, etc.

Then, after finely pulverizing the mixture using a jet mill, toner mother particles in about several-ten-odd $\mu$m particle size are obtained according to the wind power classification method. The toner mother particles are added with metallic oxide in particle size above 30 nm externally by more than 0.1% to further make up for fluidity and prevent adhesion to a photo-conductive drum and zinc stearate in a mean particle size 2-A [$\mu$m] (A is a mean particle size of toner) externally by 0.05–5.0% to accelerate the charging startup. The toner of this embodiment is thus obtained.

For the above-mentioned binder resin, copolymer of styrene and its substitution product or acrylic resin that are used so far as binder resin for toner mother particles can be used. As copolymer of styrene and its substitution product, for instance, polystyrenehomopolymer, hydrogen added styrene resin, styrene-isobutylene copolymer, styrene-butadiene copolymer, acrylonitrile-butadiene-styrene ternary copolymer, acrylonitrile-styrene-acrylic ester ternary copolymer, styrene-acrylonitrile copolymer, acrylonitrile-acrylic rubber-styrene ternary copolymer, acrylonitrile-polystyrene chloride-styrene ternary copolymer, acrylonitrile-EVA-styrene ternary copolymer, styrene-p-chlorostyrene copolymer, styrene-propylene copolymer, styrene-butadiene rubber, styrene-maleic unhydride copolymer, etc. are enumerated. Further, for acrylic resin, for instance, polyacrylate, polymethylmethacrylate, poly-n-butylmethacrylate, polyglicidilmethacrylate, polyacrylate fluoride, styrene-methacrylate copolymer, styrenebuthylmetha crylate copolymer, styrene-ethyl acrylate copolymer, etc. are enumerated.

In addition, polyvinyl chloride, polyvinyl acetate, polyethylene, polypropylene, polyester, polyurethane, polyamide, epoxy resin, phenol resin, urea resin, polyvinylbutyral, polyacrylic resin, rosin, denatured rosin, terpene resin, sliphatic or alicyclic hidrocarbon resin, aromatic petroleum resin, chlorinated paraffin wax, etc. are usable independently or in mix.

For the above-mentioned coloring agents, organic or inorganic pigments and dyes are used; for instance, Fast Yellow G, Benzidine Yellow, Indo Fast Orange, Benzimidazolone, Irgazine Red, Carmine FB, Permanent Bordeaux-FRR, Pigment Orange R, Lithol Red 2G, Lake Red C, Rhodamine FB, Rhodamine B Lake, Phthalocyanine Blue, Pigment Blue, Brilliant Green B, PhthaLocyanine Green, Quinacridone, etc. are used independently or in mix.

As metallic complexes, zirconim complex, chromium complex, zinc complex, boron complex, iron complex, etc. are enumerated.

As metallic oxides, silica ($SiO_2$), titanium oxide ($TiO_2$), alumina ($Al_2O_3$), etc. are enumerated.

Next, embodiments or comparison examples of a developer comprising a toner that was actually manufactured according to the above manufacturing method and mixed with ferrite carrier particles in a mean particle size 50 $\mu$m coated with silicon resin as carrier particles will be described.

(Embodiment 1)

Toner mother particles in a mean particle size 8 [$\mu$m] are obtained by adding 4% of azo pigment as a coloring agent and 1% of zirconium complex as the CCA to linear polyester having a softening point 100° C. Further, after externally adding 1.0% of silica in particle size 12 nm, 0.5% of silica in particle size 30 nm, and 5% zinc stearate in particle size 4[$\mu$m] to the toner mother particles, ferrite carrier is mixed and a developer 1 is obtained.

(Embodiment 2)

A developer 2 is obtained in the same manner as in the embodiment 1 except that zirconium complex is changed to chrome complex.

(Embodiment 3)

A developer 3 is obtained in the same manner as in the embodiment 1 except that the zirconium complex is changed to zinc complex.

(Embodiment 4)

A developer 4 is obtained in the same manner as in the embodiment 1 except that zirconium complex is changed to boron complex.

(Embodiment 5)

A developer 5 is obtained in the same manner as in the embodiment 1 except that zirconium complex is changed to iron complex.

(Embodiment 6)

A developer 6 is obtained in the same manner as in the embodiment 1 except that zic stearate (Zn) in particle size 7 [$\mu$m] is added externally by 0.5% for the zinc stearate in the embodiment 1.

(Embodiment 7)

A developer 7 is obtained in the same manner as in the embodiment 1 except that the amount of zinc stearate externally added is changed to 0.5%.

(Embodiment 8)

A developer 8 is obtained in the same manner as in the embodiment 1 except that the amount of zinc stearate externally added is changed to 0.05%.

(Embodiment 9)

A developer 9 is obtained in the same manner as in the embodiment 1 except that the amount of zinc stearate externally added is changed to 1%.

(Embodiment 10)

A developer 10 is obtained in the same manner as in the embodiment 1 except that titanium oxide ($TiO_2$) in a particle size 50 nm is externally added for the silica in the embodiment 1.

(Embodiment 11)

A developer 11 is obtained in the same manner as in the embodiment 10 except that the particle size of titanium oxide ($TiO_2$) is changed to 120 nm.

(Embodiment 12)

A developer 12 is obtained in the same manner as in the embodiment 10 except that the particle size of the titanium oxide ($TiO_2$) is changed to 200 nm.

(Embodiment 13)

A developer 13 is obtained in the same manner as in the embodiment 1 except that alumina ($Al_2O_3$) in a particle size 400 nm is added externally for the silica in the embodiment 1.

(Embodiment 14)

A developer 14 is obtained in the same manner as in the embodiment 13 except that the particle size of alumina ($Al_2O_3$) is changed to 1 $\mu$m.

(Embodiment 15)

A developer 15 is obtained in the same manner as in the embodiment 13 except that the particle size of alumina ($Al_2O_3$) is changed 2 $\mu$m.

Comparison Example 1

A comparing developer 1 is obtained in the same manner as in the embodiment 1 except that toner mother particles are obtained without containing zirconium complex.

Comparing Example 2

A comparing developer 2 is obtained in the same manner as in the embodiment 1 except that the zirconium complex 1 is replaced by Calixarene.

Comparing Example 3

A comparing developer 3 is obtainer in the same manner as in the embodiment 1 except that the zinc stearate is not externally added in the embodiment 1.

Comparing Example 4

A comparing developer 4 is obtained in the same manner as in the embodiment after externally adding 0.5% of calcium stearate in particle size 6 [$\mu$m] instead of zinc stearate in the embodiment 1.

Comparing Example 5

A comparing developer 5 is obtained in the same manner as in the embodiment 1 except that magnesium stearate in a particle size 7 [$\mu$m] is externally added by 0.5% for the zinc stearate in the embodiment 1.

Comparing Example 6

A comparing developer 6 is obtained in the same manner as in the embodiment 1 except that aluminum stearate in a particle size 6 [$\mu$m] is externally added by 0.5% for the zinc stearate in the embodiment 1.

Comparing Example 7

A comparing developer 7 is obtained in the same manner as in the embodiment 1 except that zinc stearate in a particle size 1 [$\mu$m] is externally added by 0.5% for the zinc stearate in the embodiment 1.

Comparing Example 8

A comparing developer 8 is obtained in the same manner as in the embodiment 1 except that zinc stearate in a particle size 10 [μm] is externally added by 0.5% for the zinc stearate in the embodiment 1.

Comparing Example 9

A comparing developer 9 is obtained in the same manner as in the embodiment 1 except that the externally adding amount of the zinc stearate in the embodiment 1 is changed to 0.01%.

Comparing Example 10

A comparing developer 10 is obtained in the same manner as in the embodiment 1 except that the externally adding amount of the zinc stearate in the embodiment 1 is changed to 7.5%.

Comparing Example 11

A comparing developer 11 is obtained in the same manner as in the embodiment 1 except that the externally adding amount of the zinc stearate in the embodiment 1 is changed to 10%.

Comparing Example 12

A comparing developer 12 is obtained in the same manner as in the embodiment 1 except that silica is of externally added.

Comparing Example 13

A comparing developer 13 is obtained in the same manner as in the embodiment 1 except that alumina ($Al_2O_3$) in a particle size 400 nm is externally added by 0.5% and zinc stearate in a particle size 1 [μm] is externally added by 0.5% for the zinc stearate in the embodiment 1.

Comparing Example 14

A comparing developer 14 is obtained in the same manner as in the comparing example 13 except that zinc stearate in a particle size 4 [μm] is externally added by 7.5%.

Using the developers 1–15 and the comparing developers 1–14 manufactured as shown above, the copy tests were conducted and further, a copied image fog and print-proof tests were conducted. The print-proof test is a comparison test of the quality of images formed, for instance, on the first printed sheet and the 30,000 th printed sheet. After this print-proof test, the toner scattering and the adhesion of toner to the photo-conductive drum were checked and further, the startup speed of the toner charging, the distribution of charged amount when the charge was saturated were checked. The copy tests was conducted using a digital copying machine (Product Name: Preimage 241) manufactured by Toshiba, equipped with an image forming unit 10, available on the market. Around a photo-conductive drum 11 of the image forming unit 10, a main charger 12, an exposing portion 13, a developing device 14, a transferring charger 16, a separation charger 17, a cleaning device 18 and a charge eliminator 20 are arranged in order along the rotating direction of arrow x.

In a toner container 22 with a total toner capacity 450 g of the developing device 14, a developer 23 comprising toner and carrier particles is contained and at its photo-conductive drum 11 side, a magnet roller 24 and a developing sleeve 25 mounted to its outside are provided. The carrier particles of the developer 23 are adhered to the surface of the developing sleeve 25 by the magnetic force of the magnet roller 24 and the toner is adhered to the surface of the carrier surfaces, forming a toner layer. The magnet roller 24 is kept stationary and the developing sleeve 25 is rotated in the arrow direction y. With this rotation of the developing sleeve 25, the developer 23 is conveyed any time.

Further, the conveying amount of the developer 23 is defined by a doctor blade 26. A reference numeral 27 denotes a power supply to apply the developing bias. At a point where the photo-conductive drum 11 and the developing sleeve 25 come close to each other, the toner is adhered to an electrostatic latent image formed on the photo-conductive drum 11 by the electrostatic attraction and the latent image is developed. Reference numerals 28 and 30 show agitating rollers that agitate and convey the developer 23 in the toner container 22 so as to friction charge the toner.

Here, the image fog was evaluated by measuring a color difference (ΔE) between an unused recording paper and the plain portion of the paper after printed using a calorimeter (made by Minolta).

The print-proof test was conducted by copying paper up to 60,000 sheets continuously using the copying machine Model Premage 241 and the evaluation was made.

The scattering and adherence of toner to the photo-conducive drum were evaluated after copying 30,000 sheets and 60,000 sheets.

25 g of toner and 475 g of carrier particles were put into a 1000 cc polyester bottle and took samples after agitating them by a Turbula Mixer for 5 min. and 60 min., measured the amount of electric charge to the toner using an E-Spart Analyzer (Hosokasa Micron Corp. made) and a charge startup rate was obtained according to (Numeral Formula 1) shown below.

(Charge Startup Rate)=(Amount of electric charge after 5 min.)/(Amount of electric charge after 60 min)×100 (Numerical Formula 1)

Figure 2:
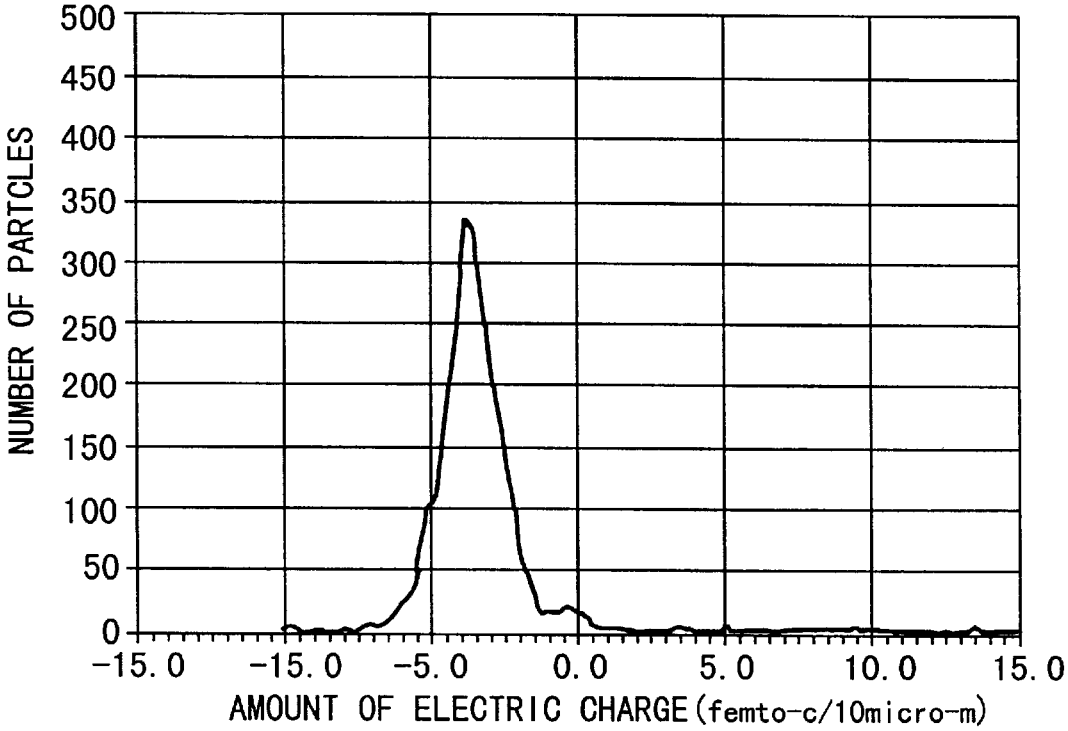
FIG. 2 is a graph showing the distribution of amount of electric charge to the number of particles of toner at the time of saturated charge to obtain a good image.

The distribution of the charged amount when saturated was evaluated using the E-Spart Analyzer. When the distribution of charged amount when saturated is less near "○" as shown in FIG. 2, a good image is obtained without causing the image fog/toner scattering. However, even when a mean charged amount at the saturated time is high and a mean charged amount similar to the toner shown in FIG. 2 is obtained, uncharged toners near "○" tend to cause the image fog/scattering when there is also the distributed toner near "○".

Fluidity of the toner was evaluated by placing 20 g toner on a 200 mesh sieve, sieving toner and measuring the remaining amount of the toner left thereon after sieved.

Thus, the evaluation results shown in (Table 1) were obtained for the developers 1–15 and the comparing developers 1–14. Further, "○" in the evaluation denotes the toner is satisfactory without causing any problem, Δ denotes usable anyhow, ×denotes not usable, and ×× denotes extremely poor.

TABLE 1

| | Metallic soap | | CCA | | Metallic oxide | | | Charged | | | Scatter | Adherence to | |
|---|---|---|---|---|---|---|---|---|---|---|---|---|---|
| | Kind of metal | Added amount | Kind | Amount amount | Kind of metal | Particle Size | Added amount | Amount distribution | Fog | Charged Startup rate | After 60K sheets | photo-conductive drum after 60K sheets | Fluidity |
| Embodiment 1 | Zn, 4 μm | 5% | Zr Complex | 1% | Silica | 30 nm<br>12 nm | 0.5%<br>1.0% | ○ | 6.6 | 76 | ○ | ○ | 7.1 |
| Embodiment 2 | Zn, 4 μm | 5% | Cr complex | 1% | " | 30 nm<br>12 nm | 0.5%<br>1.0% | ○ | 0.9 | 71 | ○ | ○ | 7.3 |
| Embodiment 3 | Zn, 4 μm | 5% | Zn complex | 1% | " | 30 nm<br>12 nm | 0.5%<br>1.0% | ○ | 1.0 | 67 | ○ | ○ | 6.9 |
| Embodiment 4 | Zn, 4 μm | 5% | B complex | 1% | " | 30 nm<br>12 nm | 0.5%<br>1.0% | ○ | 1.1 | 65 | ○ | ○ | 6.9 |
| Embodiment 5 | Zn, 4 μm | 5% | Fe complex | 1% | " | 30 nm<br>12 nm | 0.5%<br>1.0% | ○ | 1.0 | 69 | ○ | ○ | 7.0 |
| Embodiment 6 | Zn, 7 μm | 0.5% | Zn complex | 1% | " | 30 nm<br>12 nm | 0.5%<br>1.0% | ○ | 0.9 | 73 | ○ | ○ | 4.1 |
| Embodiment 7 | Zn, 4 μm | 0.5% | " | " | " | 30 nm<br>12 nm | 0.5%<br>1.0% | ○ | 0.8 | 76 | ○ | ○ | 4.1 |
| Embodiment 8 | Zn, 4 μm | 0.05% | " | " | " | 30 nm<br>12 nm | 0.5%<br>1.0% | ○ | 1.2 | 63 | ○ | ○ | 3.6 |
| Embodiment 9 | Zn, 4 μm | 1% | " | " | " | 30 nm<br>12 nm | 0.5%<br>1.0% | ○ | 0.7 | 74 | ○ | ○ | 5.2 |
| Embodiment 10 | Zn, 4 μm | 5% | " | " | Titanium oxide | 50 nm | 0.5% | ○ | 0.8 | 76 | ○ | ○ | 7.3 |
| Embodiment 11 | Zn, 4 μm | 5% | " | " | Titanium oxide | 120 nm | 0.5 | ○ | 0.9 | 72 | ○ | ○ | 7.5 |
| Embodiment 12 | Zn, 4 μm | 5% | " | " | Titanium oxide | 200 nm | 0.5 | ○ | 0.7 | 77 | ○ | ○ | 7.5 |
| Embodiment 13 | Zn, 4 μm | 5% | " | " | Alumina | 400 nm | 0.5 | ○ | 0.8 | 71 | ○ | ○ | 7.8 |
| Embodiment 14 | Zn, 4 μm | 5% | " | " | Alumina | 1 μm | 0.5 | ○ | 0.9 | 70 | ○ | ○ | 8.0 |
| Embodiment 15 | Zn, 4 μm | 5% | " | " | Alumina | 2 μm | 0.5 | ○ | 0.7 | 73 | ○ | ○ | 7.9 |
| Comparing ex. 1 | Zn, 4 μm | 5% | — | 1% | Silica | 30 nm<br>12 nm | 0.5<br>1.0 | ○ | 3.2 | 43 | Δ | ○ | 6.5 |
| Comparing ex. 2 | Zn, 4 μm | 5% | ? | 1% | " | 30 nm<br>12 nm | 0.5<br>1.0 | Δ | 1.7 | 59 | Δ | ○ | 6.8 |
| Comparing ex. 3 | — | 0% | Zn Complex | 1% | " | 30 nm<br>12 nm | 0.5<br>1.0 | ○ | 2.1 | 53 | X | ○ | 3.2 |
| Comparing ex. 4 | Co, 6 μm | 0.5% | " | " | " | 30 nm<br>12 nm | 0.5<br>1.0 | Δ | 1.5 | 64 | Δ | ○ | 4.5 |
| Comparing ex. 5 | Mg, 7 μm | 0.5% | " | " | " | 30 nm<br>12 nm | 0.5<br>1.0 | Δ | 1.5 | 68 | Δ | ○ | 3.8 |
| Comparing ex. 6 | Al, 6 μm | 0.5% | " | " | " | 30 nm<br>12 nm | 0.5<br>1.0 | Δ | 1.4 | 61 | Δ | ○ | 3.9 |
| Comparing ex. 7 | Zn, 1 μm | 0.5% | " | " | " | 30 nm<br>12 nm | 0.5<br>1.0 | ○ | 0.9 | 79 | ○ | XX | 5.1 |
| Comparing ex. 8 | Zn, 10 μm | 0.5% | " | " | " | 30 nm<br>12 nm | 0.5<br>1.0 | ○ | 1.9 | 56 | X | ○ | 4.0 |
| Comparing ex. 9 | Zn, 4 μm | 0.01% | " | " | " | 30 nm<br>12 nm | 0.5<br>1.0 | ○ | 2.2 | 52 | X | ○ | 3.3 |
| Comparing ex. 10 | Zn, 4 μm | 7.5% | " | " | " | 30 nm<br>12 nm | 0.5<br>1.0 | ○ | 0.7 | 75 | ○ | XX | 10.7 |
| Comparing ex. 11 | Zn, 4 μm | 10% | " | " | " | 30 nm<br>12 nm | 0.5<br>1.0 | ○ | 0.6 | 77 | ○ | XX | 11.3 |
| Comparing ex. 12 | Zn, 4 μm | 5% | " | " | — | . . . | . . . | ○ | 0.9 | 73 | ○ | X | 7.8 |
| Comparing ex. 13 | Zn, 1 μm | 0.5% | " | 1% | Alumina | 400 nm | 0.5% | ○ | 0.9 | 79 | ○ | X | 5.1 |
| Comparing ex. 14 | Zn, 4 μm | 7.5% | " | 1% | Alumina | 400 nm | 0.5% | ○ | 0.8 | 79 | ○ | X | 11.7 |

In the case of the developers 1–15 in the embodiments 1–15, a sufficient charge amount was obtained, the charge startup was fast and good charge amount could be retained even when toner was initially used. Further, the distribution of the charged amount at the saturated time was satisfactory and a good toner image could be obtained without causing the image fog from the time when toner was initially put in use until completing the copying of prescribed number of sheets. Further, the contamination of toner images due to the contaminated devices around the photo-conductive drum 11 by scattering toner was not observed. Further, fluidity was not inferior and adhesion of the toner to the photo-conductive drum also was not recognized.

On the contrary, the comparing developer 1 in the comparing example 1 was not able to obtain a satisfactory charge amount as toner mother particles did not contain metallic complex, was inferior in the distribution of charged amount, charge startup rate was low, and caused image fog and contamination by scattering toner.

Further, in the case of the comparing developer 2 of the comparing example 2, toner mother particles contain Calixarene as CCA, but the toner charge amount was not sufficient and although usable anyhow but image fog/toner scattering were caused.

Further, in the case of the comparing developer 3 of the comparing example 3 could obtain a sufficient charge amount by the charge control of the zirconium complex and the distribution of the charge amount was satisfactory but the charge startup rate was low as zic stearate was not added externally and image fog/toner scattering were caused.

In the case of the comparing developers 4–6 of the comparing examples 4–6, as calcium stearate, magnesium stearate and aluminum stearate were externally added instead of zinc stearate, the charge startup rate was not sufficient for all of them and were usable anyhow but image fog/toner scattering were caused.

In the case of the comparing developer 7 of the comparing example 7, as zinc stearate was externally added, the charge startup rate was satisfactory and a sufficient charge amount could be obtained, the distribution of the charge amount at the time when the charge was saturated and the image fog/toner scattering were not recognized but as the particle size of zinc stearate was as small as 1 [μm], the matching with zirconium complex was worse and the remarkable melting and adhesion of zinc stearate to the photo-conductive drum 11 was caused. Semitransparent material was adhered to the surface of the photo-conductive drum 11 in the thinly extended state and the coefficient of friction of the melted and adhered portion dropped remarkably and therefore, the defective cleaning was caused.

Further, in the case of the comparing developer 8 of the comparing example 8, zinc stearate was externally added but its mean particle size is 10 [μm] that is larger than a mean particle size 8 [μm] of the toner mother particles and therefore, its matching with zirconium complex was worse, the charge startup rate is low and the image fog/toner scattering were caused.

In the case of the comparing developer 9 of the comparing example 9, zinc stearate was externally added but its amount was less, the charge startup rate became low and the image fog/toner scattering were caused.

In the case of the comparing developers 10 and 11 of the comparing examples 10 and 11, as zinc stearate was externally added, the charge startup rate was satisfactory, a sufficient charge amount was obtained, the distribution of the charged amount at the time when the charge was saturated was satisfactory and no image fog/toner scattering were recognized but the externally added amount of zinc stearate was too much and the matching with zirconium complex was worse and the remarkable melting and adhesion of toner to the photo-conductive drum 11 were caused.

In the case of the comparing developer 12 of the comparing example 12, as metallic oxide was not added externally, the melting and adhesion of zinc stearate to the photo-conductive drum 11 was caused.

In the case of the comparing developer 13 of the comparing example 13, although alumina ($Al_2O_3$) was added as a metallic oxide externally, the particle size of zing stearate was as small as 1 [μm], the matching with zirconium complex was worse and zinc stearate was melted and adhered to the photo-conductive drum 11.

In the case of the comparing developer 14 of the comparing example 14, although alumina ($Al_2O_3$) was added as a metallic oxide externally, the externally added amount of zinc stearate was too much and the matching with zirconium complex was worse and zinc stearate was melted and adhered to the photo-conductive drum 11.

From these results, it became clear that a sufficient charge amount can be secured for the toner retained in the developer and the charge startup becomes fast by externally adding zinc stearate in particle size 2–8 [μm] by 0.05–5.0% to the toner mother particles in a mean particle size 8 [μm] containing metallic complex. It was further found that zirconium complex is a more suitable metallic complex for use as CCA and the image fog and toner scattering can be effectively prevented. In addition, it was also revealed that the melting and adhesion of zinc stearate to the photo-conductive drum 11 can be prevented when metallic oxide in particle size above 30 nm is externally added.

When the toner is composed as described above, it becomes possible to accelerate the charge startup of toner mother particles by externally adding zinc stearate to toner mother particles that have sufficient amount of electric charge as a metallic complex as CCA is contained.

Accordingly, in a small sized developing device with a less storage capacity of developer or in the full color image forming at a high printing rate, the toner will have a sufficient amount of electric charge from its initial stage of use, and image fog and contamination of devices by scattering toner can be prevented and a clear image of the good quality can be obtained. In addition, as zinc stearate is a colorless and transparent material, it becomes possible to get a clear full color image in the good quality without impairing color reproducibility and transparency. Further, as a metallic oxide is externally added, zinc stearate will not adhered to the photo-conductive drum 11. Accordingly, the deterioration of the image quality resulting from the filming of the surface of the photo-conductive drum 11 is prevented and a good toner image is obtained.

Further, the present invention is not restricted to the above embodiments but the design can be modified variously. For instance, external additives to the toner are not restricted to zinc stearate and metallic oxides of the present invention but cleaning assistant and wax may be added externally. In addition, kinds of metals of metallic complex that are used as CCA are also not restricted and further, coloring agents that are used for full color copying are also not restricted.

As explained above, according to the present invention, by adding zinc stearate externally to toner mother particles containing metallic complexes, a sufficient amount of electric charge is secured for toner mother particles without impairing color reproducibility and transparency of full color images. At the same time, the charge startup can be accelerated and a sufficient amount of electric charge can be secured from the initial use of the toner for a small sized with less developer storage capacity and in a full color image formation at a high printing rate. Accordingly, it is possible to get a clear and satisfactory toner image and improve the quality of image without causing the image fog. At the same time, the contamination of devices by scattering toners can be prevented.

What is claimed is:

1. Toner comprising:

toner mother particles having a prescribed size and containing a binder resin, coloring agent and a metallic complex including one metal selected from zirconium, zinc, boron and iron; and zinc stearate having a mean particle size of greater than 2 μm and less than the prescribed size of the toner mother particles, externally added to the toner mother particles.

2. Toner according to claim 1, wherein the zinc stearate is externally added to the toner mother particles by 0.05–5.0%.

3. Toner according to claim 1 further comprising:

a metallic oxide in a particle size more than 30 nm, externally added to the toner mother particles by more than 0.1%.

4. Toner according to claim 3, wherein the metallic oxide is at least one of silica, titanium oxide and alumina.

5. A color toner consisting essentially of:

toner mother particles having a prescribed size and containing a binder resin, coloring agent and a metallic complex including at least one metal selected from zirconium, zinc, boron and iron; and zinc stearate having a mean particle size of greater than 2 μm and less than the prescribed size of the toner mother particles, externally added to the toner mother particles.

* * * * *